US008069995B2

(12) United States Patent
Winnard

(10) Patent No.: US 8,069,995 B2
(45) Date of Patent: Dec. 6, 2011

(54) ADJUSTABLE TOOL HOLDER

(76) Inventor: Stanley D. Winnard, Carrollton, TX (US)

( * ) Notice: Subject to any disclaimer, the term of this patent is extended or adjusted under 35 U.S.C. 154(b) by 117 days.

(21) Appl. No.: 12/391,107

(22) Filed: Feb. 23, 2009

(65) Prior Publication Data

US 2009/0218303 A1 Sep. 3, 2009

Related U.S. Application Data

(60) Provisional application No. 61/030,956, filed on Feb. 23, 2008, provisional application No. 61/041,728, filed on Apr. 2, 2008.

(51) Int. Cl.
*A47F 7/00* (2006.01)

(52) U.S. Cl. ..... 211/70.6; 211/89.01

(58) Field of Classification Search ..... 211/70.6, 211/60.1, 89.01, 63–65, 70.8, 70.2–70.4, 211/68, 69.8, 69.9; 206/349
See application file for complete search history.

(56) References Cited

U.S. PATENT DOCUMENTS

| | | | | |
|---|---|---|---|---|
| 4,077,126 | A * | 3/1978 | Pletcher | 433/10 |
| 4,295,287 | A * | 10/1981 | Natzke et al. | 414/723 |
| 4,673,082 | A * | 6/1987 | Hemme | 206/315.6 |
| 4,765,129 | A * | 8/1988 | Jodoin et al. | 57/22 |
| 4,871,074 | A * | 10/1989 | Bryson et al. | 211/26 |
| 5,241,774 | A * | 9/1993 | Rayburn | 43/44.9 |
| 5,460,306 | A * | 10/1995 | Rudd | 224/557 |
| 5,467,672 | A * | 11/1995 | Ashby | 81/58.2 |
| 5,660,276 | A | 8/1997 | Winnard | |
| 6,481,583 | B1 * | 11/2002 | Black et al. | 211/70.6 |
| 6,666,204 | B1 * | 12/2003 | Hedrick | 124/86 |
| 6,732,470 | B1 * | 5/2004 | Bennett | 43/44.9 |
| 6,932,223 | B1 * | 8/2005 | Lee et al. | 211/70.6 |

* cited by examiner

*Primary Examiner* — Korie Chan
(74) *Attorney, Agent, or Firm* — Chainey P. Singleton; Chalker Flores, LLP

(57) ABSTRACT

The present invention includes an apparatus and method for holding a tool that includes one or more substantially cylindrical members, wherein each member has a longitudinal channel and a base having one or more planarly spaced substantially cylindrical openings and a longitudinal slot extending along each substantially cylindrical opening, wherein each substantially cylindrical member is secured within one of the cylindrical openings and is free to rotatively engage one or more tools.

13 Claims, 11 Drawing Sheets

ADJUSTABLE TOOL HOLDER

CROSS-REFERENCE TO RELATED APPLICATIONS

This application claims priority to U.S. Provisional Application Ser. No. 61/030,956, filed Feb. 23, 2008 and U.S. Provisional Application Ser. No. 61/041,728, filed Apr. 2, 2008, the contents of both of which are incorporated by reference herein in its entirety.

TECHNICAL FIELD OF THE INVENTION

The present invention relates in general to the field of tool holders, and in particular, an apparatus and method for securing and holding a variety of tools such that each tool is engaged by a rotating mechanism.

BACKGROUND OF THE INVENTION

In both consumer and industrial settings, there has been a growing necessity for a tool holder that operates by rotationally engaging and releasing a tool or tools. While most tool holders are capable of engaging and releasing tools with the assistance of gravity, their restraining capacity often fails to account for various environments. Instead, standardized restraints are fashioned according to a tool's size or shape. Such restraints often fail to account for a sufficient amount of environmental variables in which the tool is subjected to or used in.

For example, while a tool belt may successfully hold a socket wrench through a snap or clip in a low altitude construction setting, that same tool belt may not appropriately hold the same tool in a similar construction setting at a higher altitude. As a general rule, higher winds are present more often at higher altitudes rather than at lower altitudes. Accordingly, modern tool restraints solve such problems often by increasing took holders' tensile strengths, either by making structural or material alterations. However, along with such changes comes compromised ease of use, weight, tool accessibility, as well as numerous other problems.

Such problems are especially commonplace in environments which include turbomachinery and other similar surroundings involving the generation of unusually large forces. Not only must the tool holder be secured, but the tools it holds must be readily available, quickly accessible, neatly organized, and yet able to be restrained and released at a moments notice. In such environments, traditional tool holders which attempt to solve such problems at best are inefficient, as with increased tensile strengths, comes unacceptable compromises in efficiency.

As a consequence of the foregoing, a longstanding need exists among users for an apparatus and method allowing for the quick, simple, and effective storage and retrieval of tools in high energy environments.

SUMMARY OF THE INVENTION

In accordance with the present invention, an apparatus and method are provided to allow for the more efficient storage and retrieval of tools in a variety of environments. The present invention provides an adjustable tool holder which functions by rotatively engaging one or more tools. The functional attributes of the present invention avoid the need for structural or material alterations when tools need to be held, stored, and released in various settings.

One embodiment of the present invention may include one or more substantially cylindrical members where each member has a longitudinal channel, along with a base that has one or more planarly spaced substantially cylindrical openings and a longitudinal slot extending along each substantially cylindrical opening. Each substantially cylindrical member is secured within one of the cylindrical openings and is free to rotatively engage one or more tools. However, another embodiment may have one or more first flanges extending from the annulus of each substantially cylindrical member and one or more grasps extending from the perimeter of each substantially cylindrical opening, in which the one or more first flanges are disposed within each grasp to constrain the rotation of one or more substantially cylindrical members. Also, the present invention also may have one or more second flanges extending from an end plane of each substantially cylindrical member and one or more slidable members attached to each second flange. That way, each slidable member may cause one or more substantially cylindrical members to rotate.

Furthermore, another embodiment may have one or more first flanges extending from the annulus of each substantially cylindrical member, one or more grasps extending from the perimeter of each substantially cylindrical opening, one or more second flanges extending from an end plane of each substantially cylindrical member, and one or more slidable members attached to each second flange. Each slidable member may then cause one or more substantially cylindrical members to rotate so long as one or more first flanges are disposed within each grasp to constrain the rotation of one or more substantially cylindrical members. In addition, the present invention may have one or more latching members attached to the base and one or more slidable members, one or more first flanges extending from the annulus of each substantially cylindrical member, one or more grasps extending from the perimeter of each substantially cylindrical opening, and one or more second flanges extending from an end plane of each substantially cylindrical member. So long as one or more slidable members are attached to each second flange, each latching member will cause one or more substantially cylindrical members to rotate in unison.

Alternately the present invention may be arranged such that one or more latching members attached to the base and each slidable member, one or more first flanges extending from the annulus of each substantially cylindrical member, one or more grasps extending from the perimeter of each substantially cylindrical opening and one or more second flanges extending from an end plane of each substantially cylindrical member. So long as each slidable member is attached to each second flange, each latching member may cause each substantially cylindrical member to rotate in unison. Still another embodiment may include one or more latching members attached to the base and each slidable member, one or more locking members attached to the base and each latching member, one or more first flanges extending from the annulus of each substantially cylindrical member, one or more grasps extending from the perimeter of each substantially cylindrical opening, and one or more second flanges extending from an end plane of each substantially cylindrical member. So long as each slidable member is attached to each second flange, each latching member may causes each substantially cylindrical member to rotate in unison, while each locking member prevents further movement of each latching member.

Also, the present invention may have one or more sets of substantially cylindrical members. Yet another embodiment may include two or more substantially cylindrical members are of equal diameters. Additionally another embodiment may have one or more sets of substantially cylindrical members, where each set of substantially cylindrical members have equal diameters. Furthermore, another embodiment may include two or more substantially cylindrical members with equally spaced planar faces. Alternately, the present invention may have one or more sets of substantially cylindrical members, where each set of substantially cylindrical members has equally spaced planar faces. Another embodiment may have one or more substantially cylindrical members which are metallic or non-metallic or magnetic or non-magnetic or elastomeric or non-elastomeric or malleable or non-malleable. Also the present invention may have a base which is metallic or non-metallic or magnetic or non-magnetic or elastomeric or non-elastomeric or malleable or non-malleable.

Still another embodiment may have one or more latching members attached to the base and one or more slidable members, one or more first flanges extending from the annulus of each substantially cylindrical member, one or more grasps extending from the perimeter of each substantially cylindrical opening, and one or more second flanges extending from an end plane of each substantially cylindrical member. So long as one or more slidable members are attached to each second flange, each latching member may cause one or more substantially cylindrical members to rotate in unison, while each latching member is metallic or non-metallic or magnetic or non-magnetic or elastomeric or non-elastomeric or malleable or non-malleable.

Furthermore, a tool may be stored by sliding one or more slidable members where one or more longitudinal channels align with one or more longitudinal slots. One or more tools may be disposed by passing each tool through one or more longitudinal slots into each longitudinal channel. Last, each tool may be rotatively engaged by revolving one or more substantially cylindrical members such that one or more flanges abut one or more grasps. Alternatively, another embodiment may have one or more latching members attached to the base and one or more slidable members where each latching member causes one or more substantially cylindrical members to rotate in unison. Then one or more slidable members may rotatively engage one or more tools. Also the present invention may have one or more latching members attached to the base and one or more slidable members with each latching member causing each substantially cylindrical member to rotate in unison. By moving one or more slidable members, one or more tools will be rotatively engaged.

Alternatively, another embodiment may have one or more latching members attached to the base and each slidable member, one or more locking members attached to the base and each latching member. Each latching member causes each substantially cylindrical member to rotate in unison and each locking member prevents further movement of each latching member. Moving one or more slidable members rotatively engages one or more tools and moving one or more locking members, lockedly engages each slidable member to the base. Furthermore each substantially cylindrical member having a longitudinal channel may be manufactured using injection molding, sintering, die casting, or machining. Similarly, the base may be manufactured using injection molding, sintering, die casting, or machining.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1A:
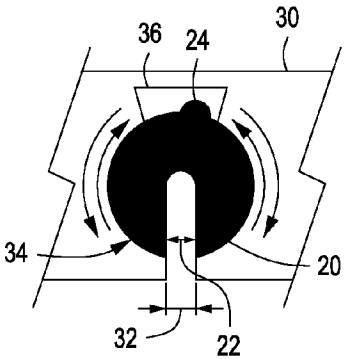
FIG. 1 illustrates three cut out views of embodiments of a substantially cylindrical member rotating within a planarly spaced substantially cylindrical opening.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The substantially cylindrical members and other parts of the tool holder of the present invention may be made from a wide variety of materials that are, e.g., metallic or non-metallic or magnetic or non-magnetic or elastomeric or non-elastomeric or malleable or non-malleable or the one or more second restraints are metallic or non-metallic or magnetic or non-magnetic or elastomeric or non-elastomeric or malleable or non-malleable. Also, the present invention may be made such that the base is metallic or non-metallic or magnetic or non-magnetic or elastomeric or non-elastomeric or malleable or non-malleable. Examples of materials include metals, plastics, polymers, wood, alloys, composites and the like. The metals may be made from one or more metals, such as steel, stainless steel, aluminum, titanium, nickel, magnesium, or any other structural metal. Examples of plastics or polymers may include: nylon, polyethylene (PE), polypropylene (PP), polyester (PE), polytetraflouroethylene (PTFE), acrylonitrile butadiene styrene (ABS), polyvinylchloride (PVC), or polycarbonate, for example, GE's Lexan® polycarbonate, and combinations thereof, among other plastics. The tool restraint taught herein may be molded, sintered, machined and/or combinations thereof to form the required pieces to assemble the tool restraint components.

The present invention may also include magnetic surfaces that help to retain the tools. As used herein, the term "tool retainer" refers to a mechanical or magnetic device that controls the movement of a tool in one or more dimensions. Non-limiting examples of tool retainers include plastics, metals, magnets, fibers, polymers, pressure fittings, mesh, bags, cylinders or vessels that are disposed in the substantially cylindrical member. For example, a wide variety of permanent magnets may be used with the present invention such as rare earth magnets, ceramic magnets, alnico magnets, which may be rigid, semi-rigid and flexible magnets. Flexible magnets are made by impregnating a flexible material such as neoprene rubber, vinyl, nitrile, nylon or a plastic with a material such as iron flakes having magnetic characteristics and will find use with the present invention. The tool may be retained by friction, compression or a fitting that prevents gravity from permitting the tool to drop out of the tool retainer that is fitted within a substantially cylindrical member. The tool retainer may have any of a variety of shapes, openings and designs, including custom designs for retaining a particular tool (e.g., a screwdriver) or non-custom tool retainers that may be used for any of a variety of tools (e.g., a grasp that expands to retain tools of different sizes, materials and/or widths (e.g., different size wrenches).

Figure 1B:
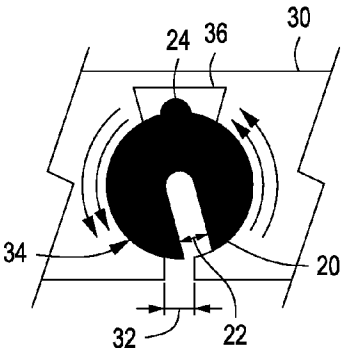
Figure 1C:
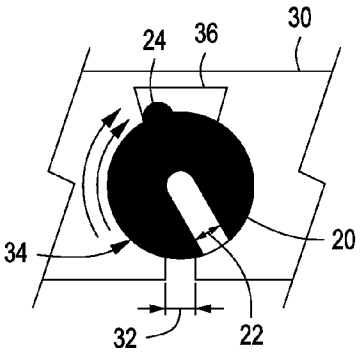
Figure 3B:
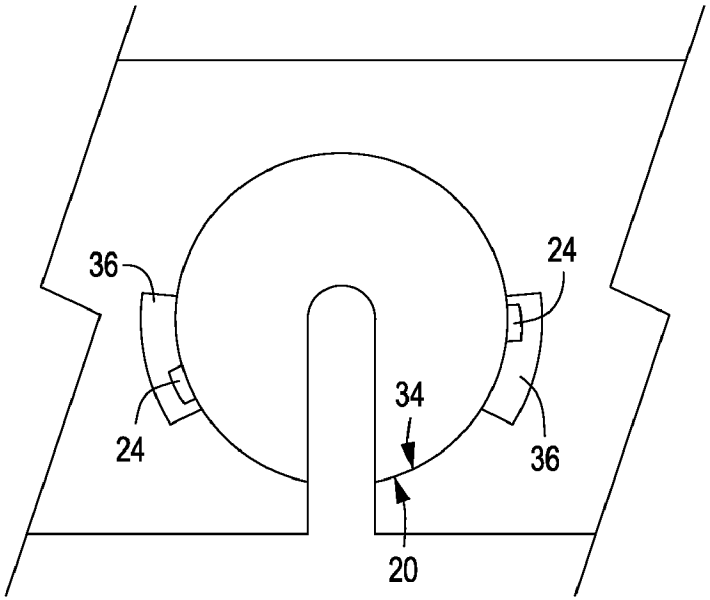
FIG. 3 depicts various embodiments in which one or more first flanges are constrained within one or more grasps.
Figure 3A:
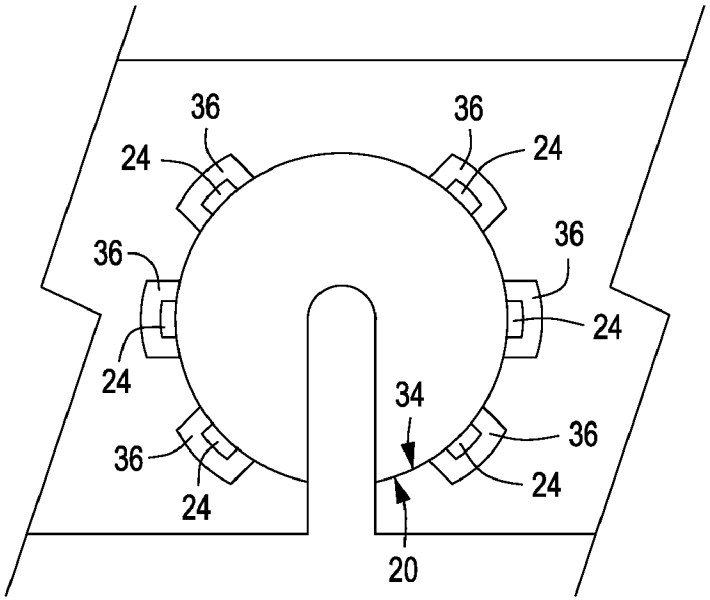
Figure 3D:
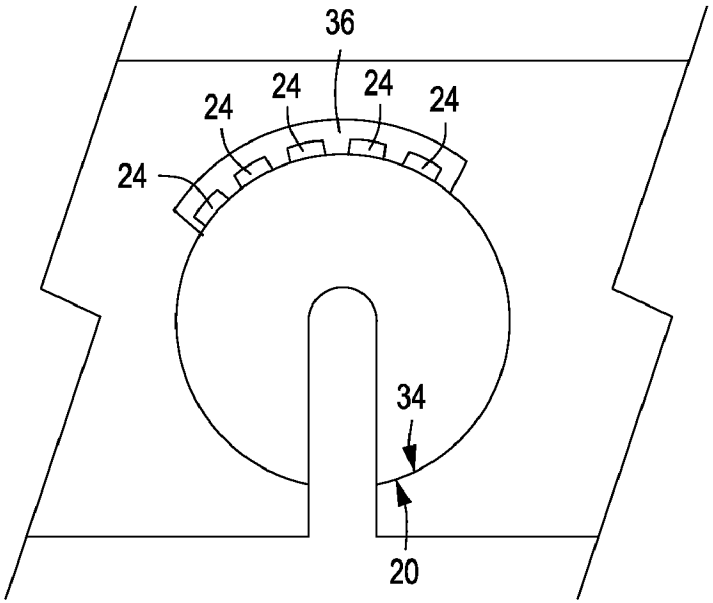
Figure 3C:
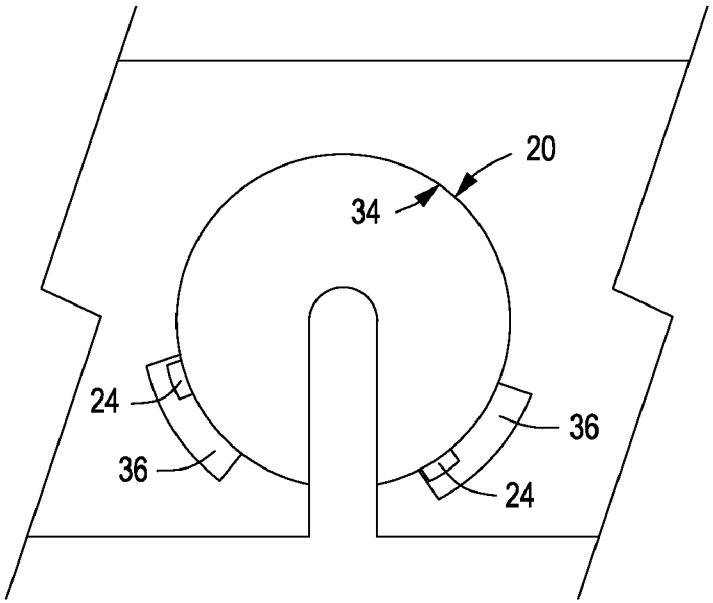
Figure 3F:
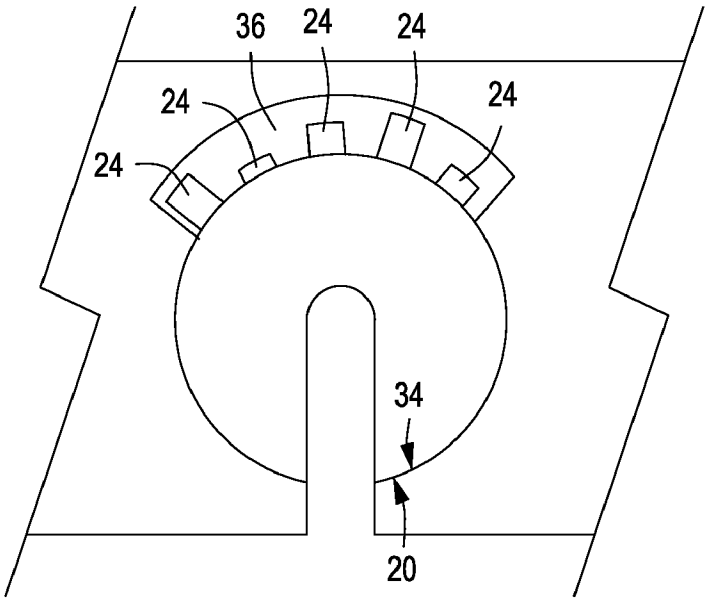
Figure 3E:
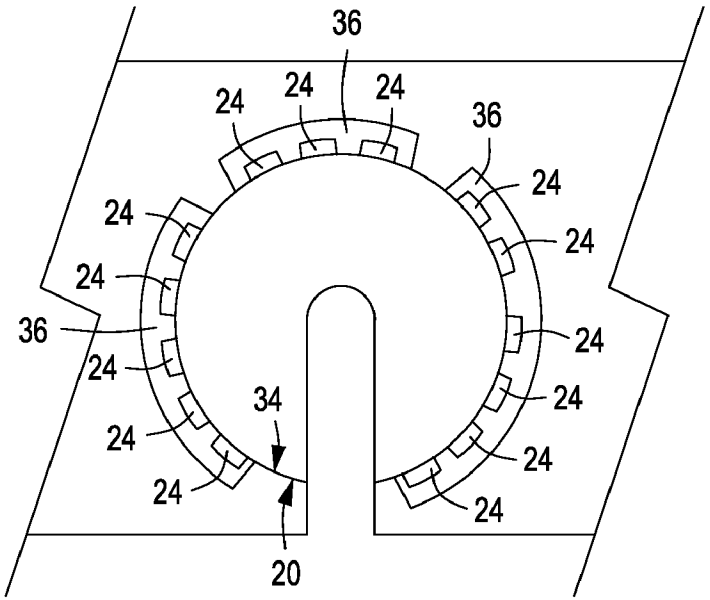
Figure 4:
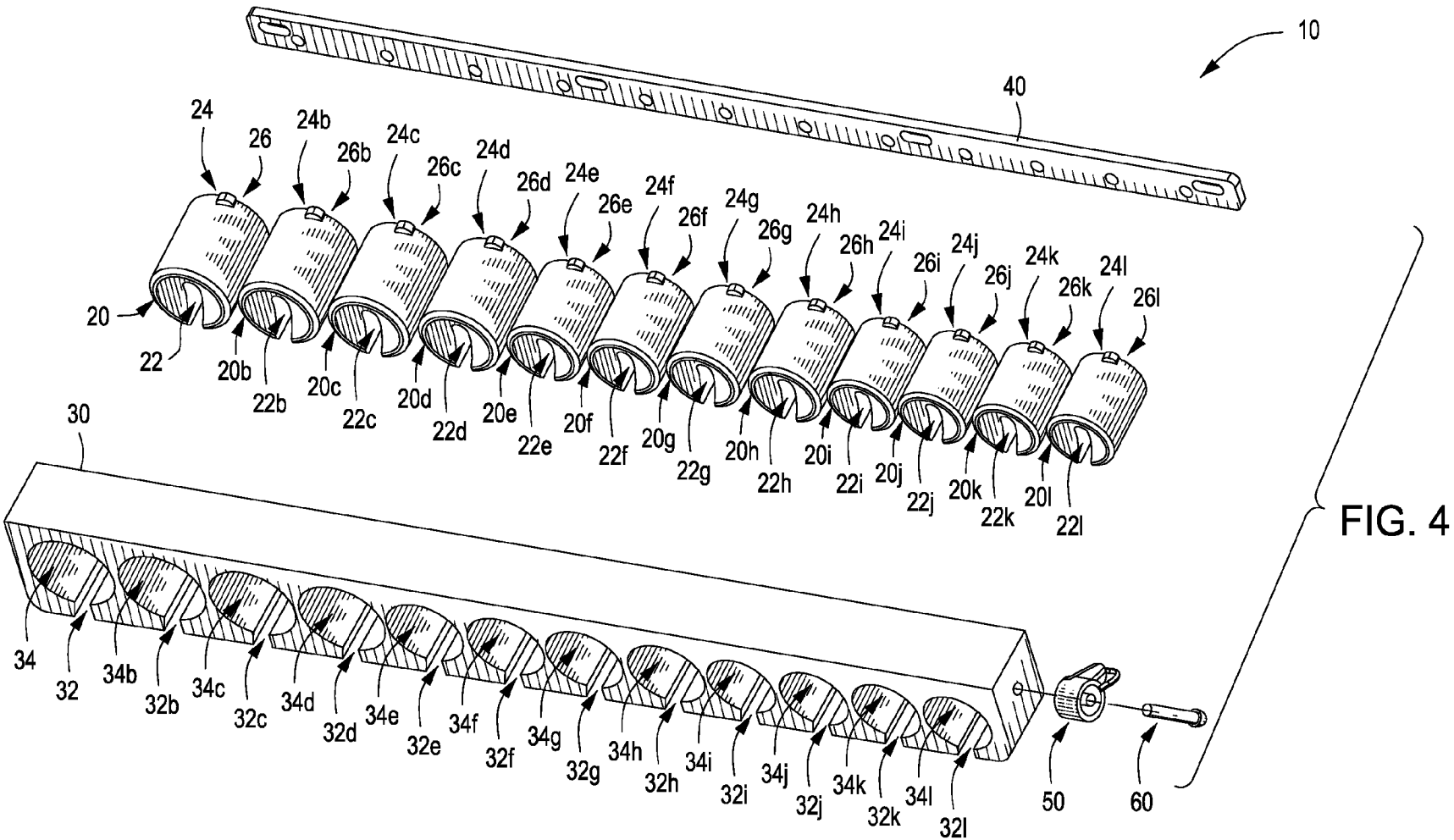
FIG. 4 illustrates an embodiment of an exploded isometric view of one or more substantially cylindrical members, a base with one or more planarly spaced substantially cylindrical openings, a slidable member, a latching member, and a locking member.

In accordance with the present invention, a tool holder 10, depicted in FIG. 4, is shown including one or more substantially cylindrical members 20, a base 30 with one or more planarly spaced substantially cylindrical openings 34, a sliding member 40, and a latching member 50. Each substantially cylindrical member 20 has a longitudinal channel 22, one or more first flanges 24, and one or more second flanges 26. The base 30 has one or more planarly spaced substantially cylindrical openings 34, each accompanied by a longitudinal slot 32 and each having one or more grasps 36, shown in FIGS. 1, 2, and 3. Each substantially cylindrical member 20 is secured within one of the cylindrical openings and is free to rotatively engage one or more tools. One or more tools can be disposed and may be restrained within, by or about each substantially cylindrical member 20. Each substantially cylindrical member 20 then rotatively engages one or more tools by turning in a manner such that one or more first flanges 24 abuts one or more grasps 36.

FIG. 1 illustrates three cut out views of an embodiment of an substantially cylindrical member 20 rotating within a planarly spaced substantially cylindrical opening 32 which extends from the base 30. These particular embodiments depict the substantially cylindrical member 20 with one first flange 24 within one grasp 36.

Illustration (FIG. 1*a*) shows a longitudinal channel 22 aligned with a longitudinal slot 32 so that a tool may be inserted and the substantially cylindrical member 20 may rotate in one or more directions within the substantially cylindrical opening 34 until it is engaged.

Illustration (FIG. 1*b*) shows a longitudinal channel 22 partially aligned with a longitudinal slot 32, where the substantially cylindrical member 20 has begun to rotate within the substantially cylindrical opening 34, such that a tool may be considered partially engaged.

Illustration (FIG. 1*c*) shows a longitudinal channel 22 not aligned with a longitudinal slot 32, where the substantially cylindrical member 20 has fully rotated such that a tool may be considered rotationally engaged, as a first flange 24 abuts with a grasp 36.

Figure 2A:
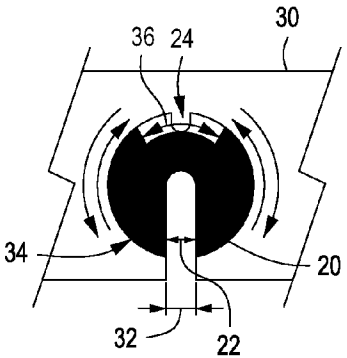
FIG. 2 illustrates three cut out views of embodiments of a substantially cylindrical member rotating within a planarly spaced substantially cylindrical opening in which a first flange and grasp are placed at different orientations than in FIG. 1.
Figure 2B:
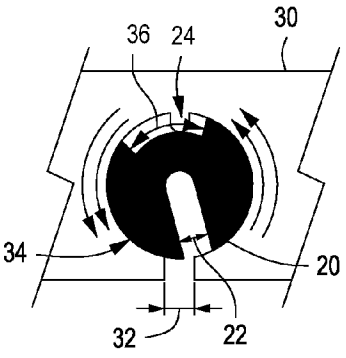
Figure 2C:
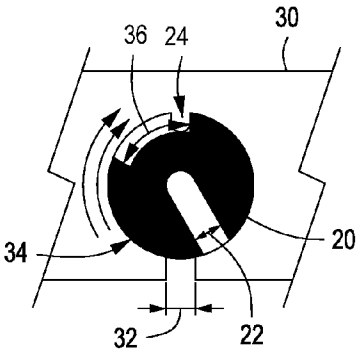

FIG. 2 illustrates three cut out views of an embodiment of a substantially cylindrical member 20 rotating within a planarly spaced substantially cylindrical opening 34 which extends from the base 30. In each illustration a substantially cylindrical member 20 is rotating within a substantially cylindrical opening similar to FIG. 1. This embodiment is included to clarify that a flange 24 need not necessarily extend in an outward manner from a substantially cylindrical member 20, but may also extend in a cavitation like manner. The embodiment is also included to clarify that a grasp 36 need not necessarily extend in an inward manner from a substantially cylindrical opening 34, but may also extend in a protrusion like manner.

FIG. 3 depicts various embodiments in which one or more first flanges 24 are constrained within one or more grasps 36. These depictions are only a small sample of combinations in which one or more first flanges 24 may be constrained within one or more first grasps 36. Neither the shape nor the position of either one or more first flanges 24 or one or more grasps 36 is limited by this or any other embodiment.

For example, in FIG. 3A, six first flanges 24 extending from a substantially cylindrical member 20 could be constrained within six grasps 36 extending from a substantially cylindrical opening 34. Furthermore each of the six first flanges 24 could extend in such a manner that they are positioned to separately abut a separate grasp 36. Similarly two flanges 24 could extend in such a manner that they are positioned to about a separate grasp 36.

Moreover, as shown in FIG. 3D, any number of first flanges 24 may be constrained within one grasp 36. Additionally, FIG. 3E shows that any number of first flanges 24 may be constrained within more than one grasp 36. Furthermore, as shown in FIG. 3F, one or more first flanges 24 may extend at different lengths from other first flanges 24 while constrained within one or more grasps 36. Additionally one or more first flanges 24 may extend at different lengths and angles while constrained within one or more grasps 36.

FIG. 4 illustrates an exploded isometric view of an embodiment of the adjustable tool holder 10 that includes one or more substantially cylindrical members 20, a base 30 with one or more planarly spaced substantially cylindrical openings 34, a slidable member 40, a latching member 50, and a locking member 60.

Each of the one or more substantially cylindrical members 20, 20*b*, 20*c*, 20*d*, 20*e*, 20*f*, 20*g*, 20*h*, 20*i*, 20*j*, 20*k*, 20*l* have a longitudinal channel 22, 22*b*, 22*c*, 22*d*, 22*e*, 22*f*, 22*g*, 22*h*, 22*i*, 22*j*, 22*k*, 22*l*, a first flange 24, 24*b*, 24*c*, 24*d*, 24*e*, 24*f*, 24*g*, 24*h*, 24*i*, 24*j*, 24*k*, 24*l*, extending from the annulus and a second flange 26, 26*b*, 26*c*, 26*d*, 26*e*, 26*f*, 26*g*, 26*h*, 26*i*, 26*j*, 26*k*, 26*l* extending from an end plane.

The base 30 has one or more planarly spaced substantially cylindrical openings 34, 34*b*, 34*c*, 34*d*, 34*e*, 34*f*, 34*g*, 34*h*, 34*i*, 34*j*, 34*k*, 34*l* and with each planarly spaced substantially cylindrical opening 34 having longitudinal slots 32, 32*b*, 32*c*, 32*d*, 32*e*, 32*f*, 32*g*, 32*h*, 32*i*, 32*j*, 32*k*, 32*l*, shown in FIG. 4. Although this embodiment does not portray the one or more attached grasps 36, shown in FIGS. 1, 2, and 3, each substantially cylindrical opening 34 also has one or more grasps 36, 36*b*, 36*c*, 36*d*, 36*e*, 36*f*, 36*g*, 36*h*, 36*i*, 36*j*, 36*k*, 36*l*, not shown. Each longitudinal channel 22 and each longitudinal slot 32 may fully or partially extend throughout one or more of the substantially cylindrical members 20 or the base 30 respectively.

A slidable member 40 is also depicted in FIG. 4. In this particular embodiment one slidable member 40, may be attached to one or more second flanges 26, 26*b*, 26*c*, 26*d*, 26*e*, 26*f*, 26*g*, 26*h*, 26*i*, 26*j*, 26*k*, 26*l* which extend from and may cause the rotation of one or more substantially cylindrical members 20, 20*b*, 20*c*, 20*d*, 20*e*, 20*f*, 20*g*, 20*h*, 20*i*, 20*j*, 20*k*, 20*l*. Additionally one slidable member 40 may cause the rotation of some of one or more substantially cylindrical members 20, 20*b*, 20*c*, 20*d*, 20*e* while another slidable member 40*b* (not depicted in this particular embodiment) may cause the rotation of other substantially cylindrical members 20*f*, 20*g*, 20*h*, 20*i*, while other substantially cylindrical members 20*j*, 20*k*, 20*l* may rotate free of any slidable member 40. Along those same lines, if just one slidable member 40 is implemented, it need not necessarily cause the rotation of each substantially cylindrical member 20, 20*b*, 20*c*, 20*d*, 20*e*, 20*f*, 20*g*, 20*h*, 20*i*, 20*j*, 20*k*, 20*l* present. Some substantially cylindrical members 20, 20*c*, 20*d*, 20*e*, 20*f*, 20*l* may be rotated through one or more slidable members 40, while other substantially cylindrical members may rotate independent of one or more slidable members 40.

Additionally, one or more latching members 50, shown in FIG. 4, may or may not be attached to the base and each slidable member 40. A latching member 50 may be connected to one slidable member 40 that causes the rotation of one or more substantially cylindrical members 20, 20*b*, 20*c*, 20*d*, 20*e*, 20*f*, 20*g*, 20*h*, 20*i*, 20*j*, 20*k*, 20*l*. Alternatively a latching member 50 may be connected to a slidable member 40 which controls some of one or more substantially cylindrical members 20, 20*b*, 20*c*, 20*d*, 20*e*, 20*f*. Another latching member 50*b* (not depicted) may be connected to another slidable member 40*b* (not depicted) which controls other substantially cylindrical members 20*g*, 20*h* while other substantially cylindrical members 20*i*, 20*j* may be controlled by another slidable member 40*c* (not depicted) not connected to any latching member 50, while still other substantially cylindrical members 20*k*, 20*l* rotate free of any sliding member 40 or latching member 50. Furthermore, one or more locking members 60, may be attached to any latching member 50 to prevent movement of each latching member 50. A latching member 50 may have a locking member 60 attached while another latching member 50*b* (not depicted) may not have a locking member attached 60*b* (not depicted).

Figure 5:
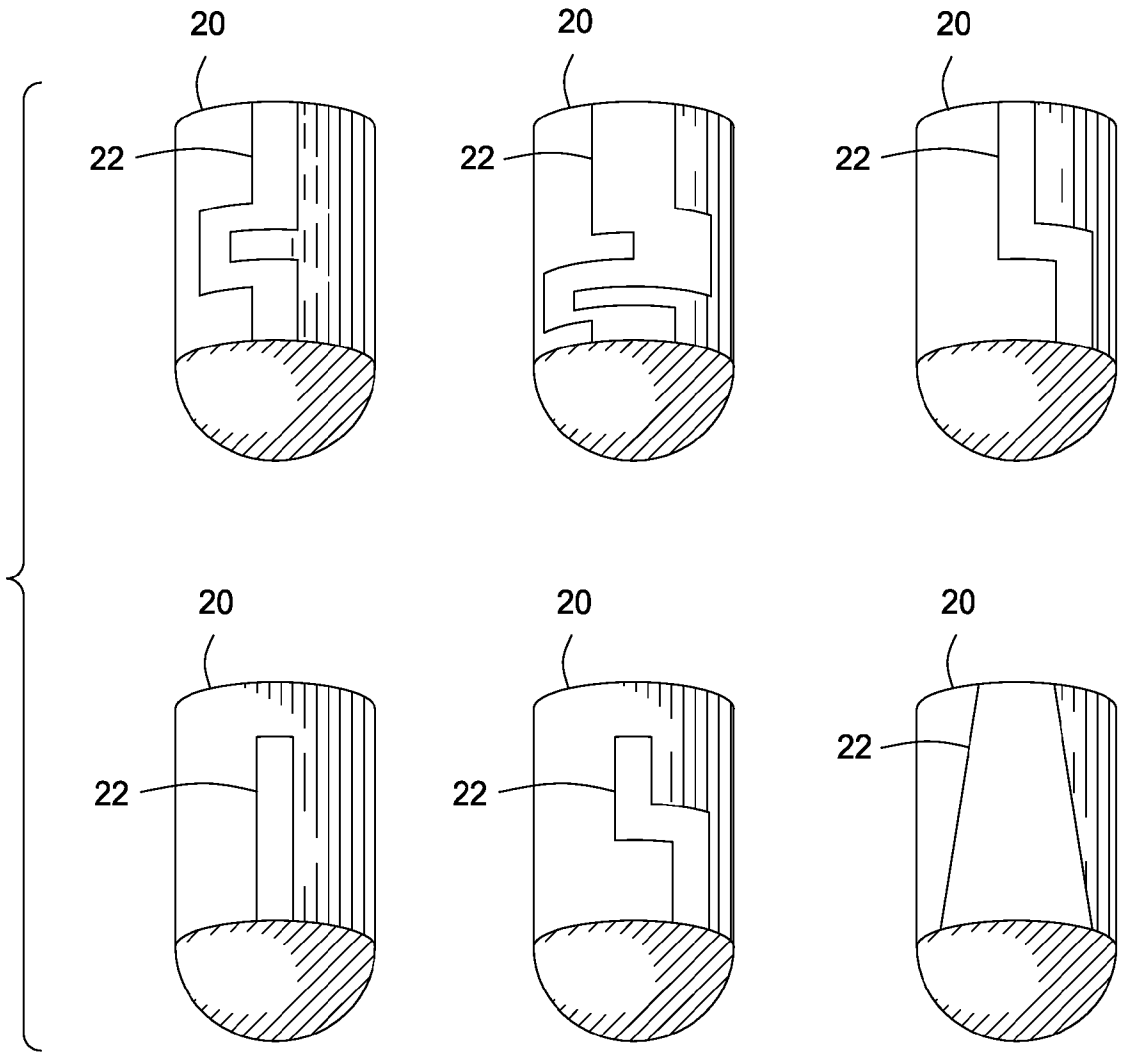
FIG. 5 depicts several cut-out top views of embodiments of a substantially cylindrical member with a longitudinal channel.

FIG. 5 depicts several cut-out top views of embodiments of a substantially cylindrical member 20 with a longitudinal channel 22. Accordingly the longitudinal channel 22 need not always be shaped in parallel. Furthermore the longitudinal channel 22, may take form of a variety of shapes, including that of a trapezoid as depicted. The longitudinal channel 22 may also zigzag throughout along the annulus of the substantially cylindrical member 20. Also the longitudinal channel 22, does not necessarily have to extend throughout the annulus of each substantially cylindrical member 20. The longitudinal channel 22 may extend only partially throughout the annulus of each substantially cylindrical member 20. Additionally one longitudinal channel 22 longitudinally extending along the annulus of one substantially cylindrical member 20 need not necessarily extend in the same shape, fashion, or form of another longitudinal channel 22 extending from another substantially cylindrical member 20.

Figure 6A:
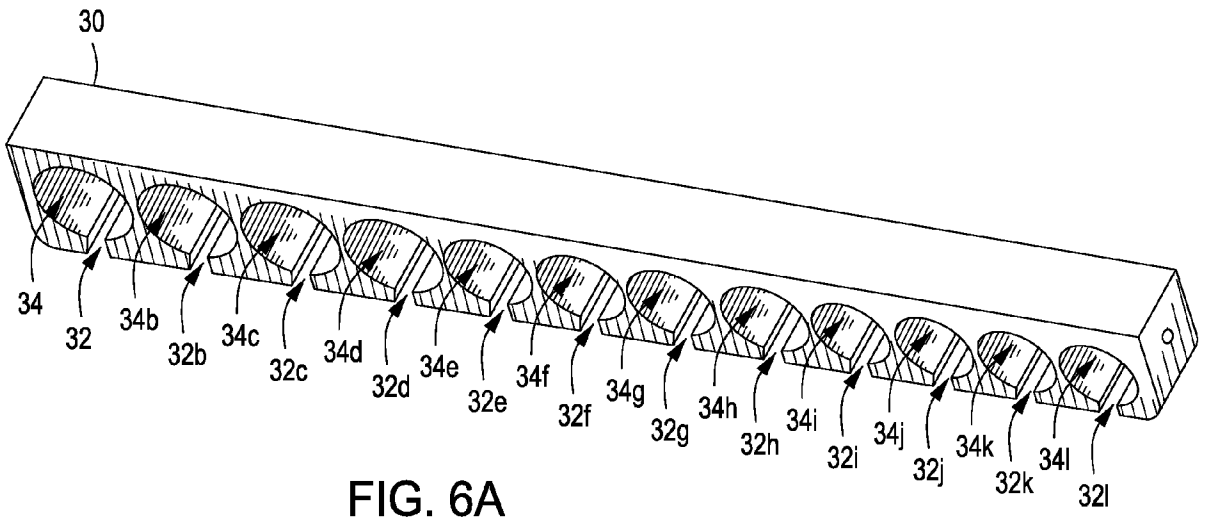
FIG. 6 is an embodiment depicting an isometric view and side view of the base along with one or more substantially cylindrical openings each with its respective longitudinal slot.
Figure 6B:
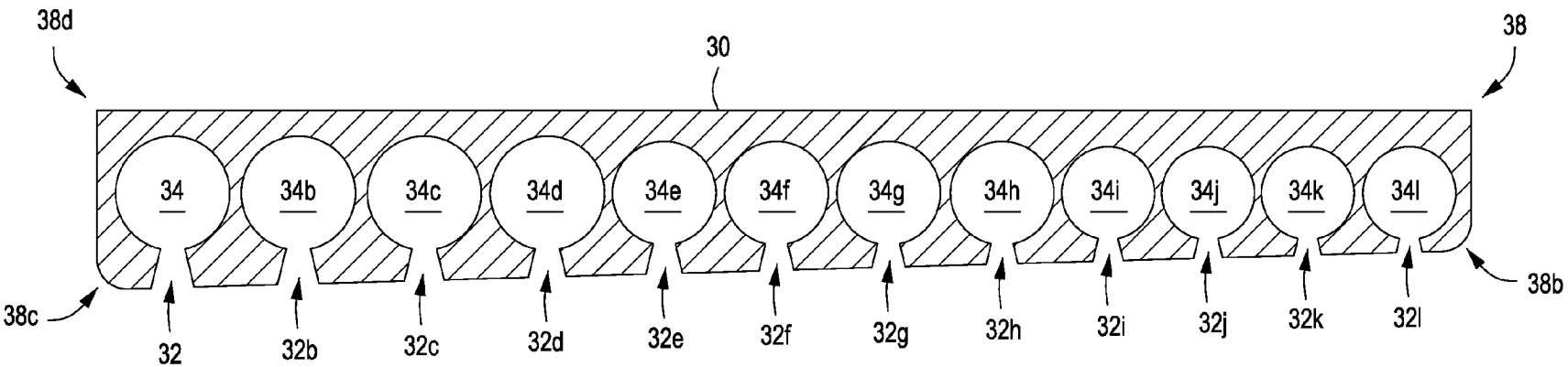

FIG. 6 depicts an embodiment of an isometric view and side view of the base 30 along with one or more substantially cylindrical openings 34 each with its respective longitudinal slot 32. As depicted by this embodiment, the shape of the base 30 may take any form. The base 30 may take a general blocked form as depicted. Additionally the base 30 may have more than one plane and may have more than six planes as depicted. One plane of the base 30 may take a generally trapezoidal shape, as depicted, while another plane of the base 30 may take a different form. Perhaps one or more planes of the base may be curved. The base 30 may have one or more edges 38, or its shape may preclude it from having one or more edges 38. One edge 38 of the base 30 may be formed at an angle of about 90 degrees, while another edge 38*b* of the base 30 may have an angle of less than 90 degrees. Any edge 38 of the base 30 may be substantially rounded. Similarly any edge 38 of the base 30 need not take the same form as another edge 38*b*, 38*c*, 38*d* of the base 30. Furthermore any longitudinal slot 32 may extend in any form and may but need not necessarily extend in the same shape, form, or fashion any other longitudinal slot 32*b*, 32*c*, 32*d*, 32*e*, 32*f* as depicted.

Additionally the one or more substantially cylindrical openings 34, shown in FIG. 6, may but need not take the same size or shape as any other substantially cylindrical opening 34*b*, 34*c*, 34*d*, 34*e*, 34*f*, 34*g*, 34*h*, 34*i*, 34*j*, 34*k*, 34*l* as depicted. Some substantially cylindrical openings 34, 34*b* may have equal diameters as other substantially cylindrical openings 34*c*, 34*d*, while having unequal diameters with other substantially cylindrical openings 34*e*, 34*f*, 34*g*, 34*h*, 34*i*, 34*j*, 34*k*, 34*l*. Furthermore one or more substantially cylindrical openings 34, 34*b*, 34*c*, 34*d* may operate as a set while other substantially cylindrical openings 34*i*, 34*j*, 34*k*, 34*l* operate as another set as depicted. One substantially cylindrical opening 34*b* of a set with other substantially cylindrical openings 34, 34*b*, 34*c*, 34*d*, need not necessarily have an equal diameter as another member 34*c* of the same set of substantially cylindrical members 34, 34*b*, 34*c*, 34*d*.

Figure 7:
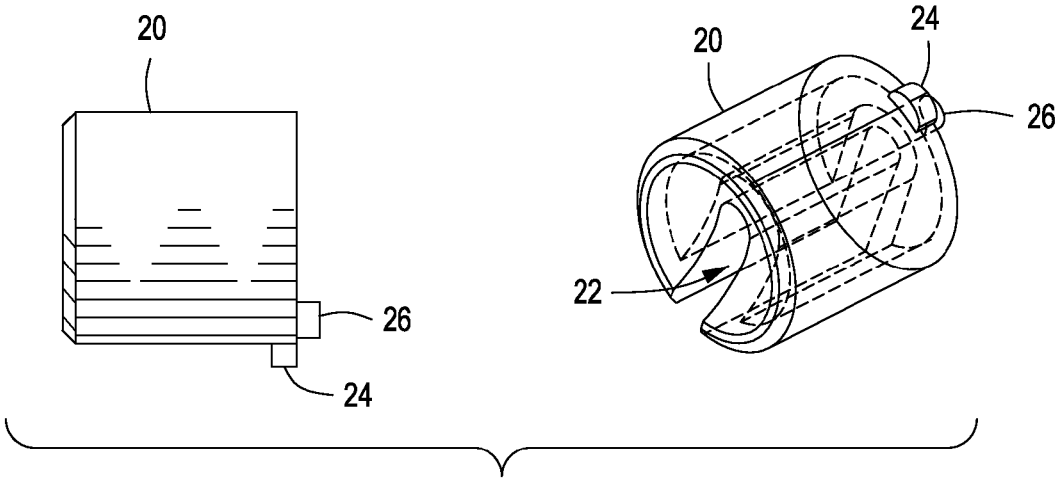
FIG. 7 depicts an embodiment of a substantially cylindrical member having a longitudinal channel, a first flange, and a second flange.

FIG. 7 depicts an embodiment of a substantially cylindrical member 20 having a longitudinal channel 22 a first flange 24 and a second flange 26. Though this depiction includes a first flange 24 extending near the second flange 26 extending from an end plane of the substantially cylindrical member 20, this need not be the case. A first flange 24 may extend anywhere about the annulus. Additionally one or more first flanges 24 may extend along the entire annulus of the substantially cylindrical member 20 or only extend along part of the annulus of the substantially cylindrical member 20 as depicted. Furthermore a first flange 24 may extend partially or entirely along the annulus of the substantially cylindrical member, while another first flange 24*b* (not depicted) extends partially or entirely along the same annulus of the substantially cylindrical member 20.

Though this depiction only includes one second flange 26 extending from an end plane of a substantially cylindrical member 26, additional second flanges 26*b* (not depicted) may extend from an end plane of the same substantially cylindrical member 26. One or more second flanges 26, need not necessarily extend from the same position as other second flanges 26.

Figure 8:
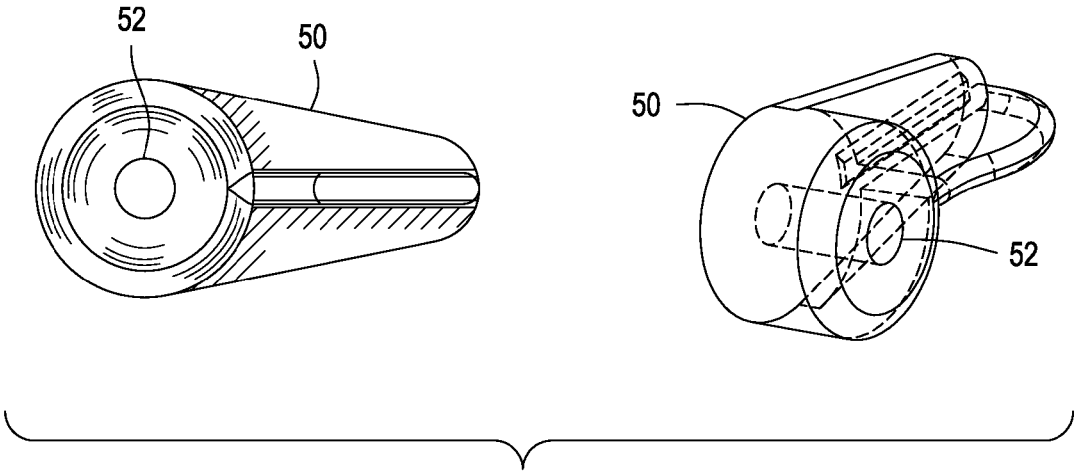
FIG. 8 depicts an embodiment of a latching member.

FIG. 8 depicts an embodiment of a latching member 50. This particular embodiment has a circular pivot 52 which may be attached to the base 30 shown in FIG. 4. A latching member 50 need not necessarily be attached to the base 30 by the circular pivot 52. The circular pivot 52 may be whole or hollow. If a latching member 50 has a circular pivot 52 and that circular pivot 52 is hollowed, a locking mechanism 60, shown in FIG. 4, may be inserted through the circular pivot 52 to prevent movement of the latching member 50.

Figure 9:
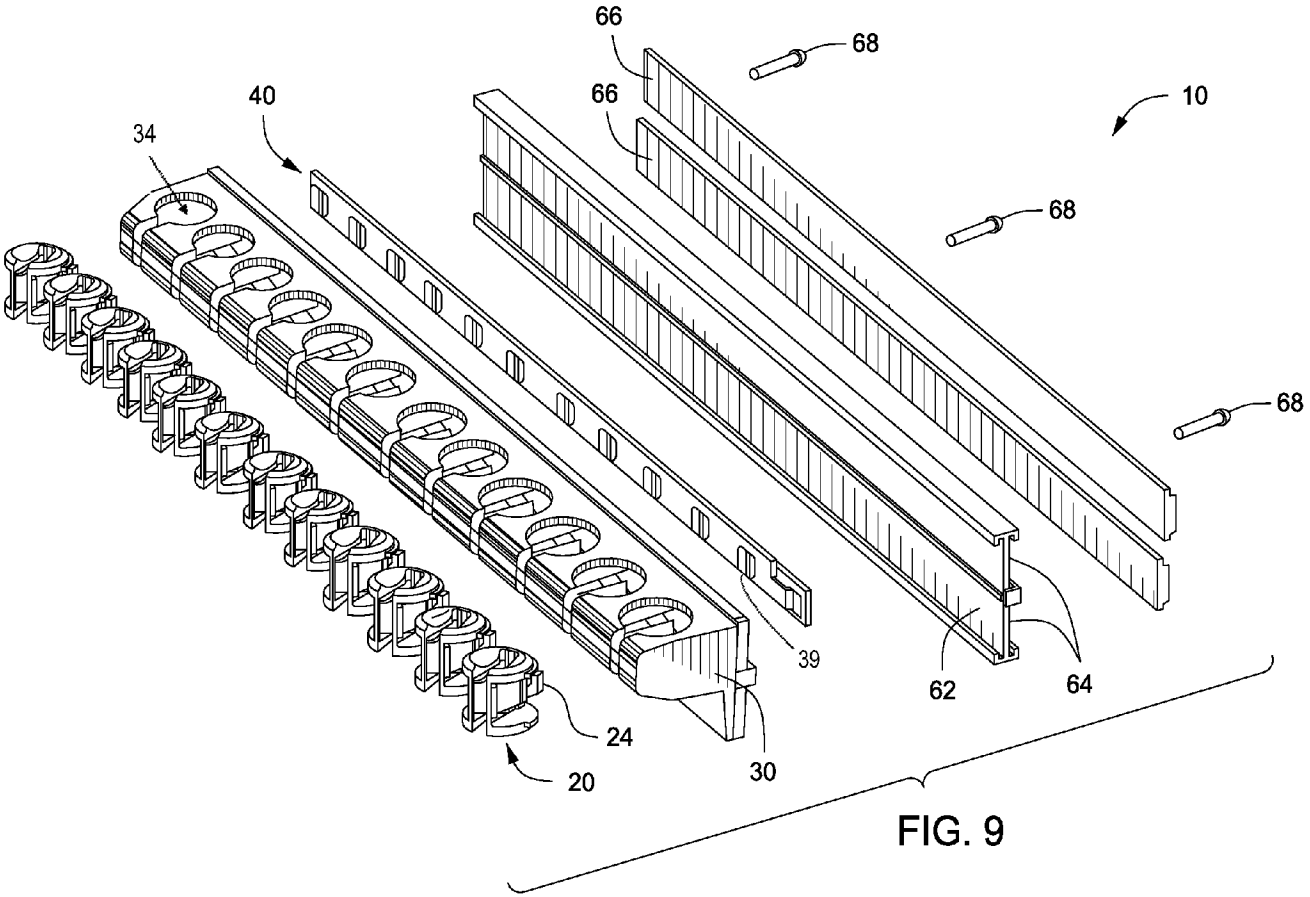
FIG. 9 is an exploded view of one embodiment of the adjustable tool holder of the present invention.
Figure 10A:
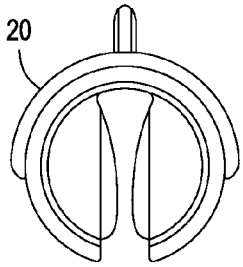
FIG. 10 depicts detailed views of one embodiment of the substantially cylindrical member.
Figure 10B:
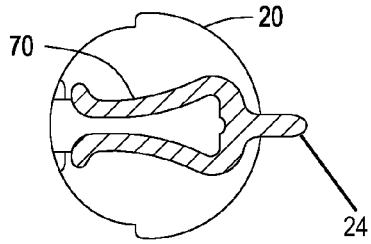
Figure 10C:
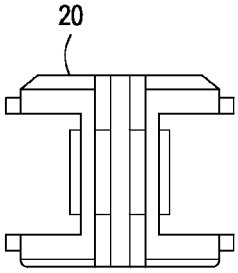
Figure 10D:
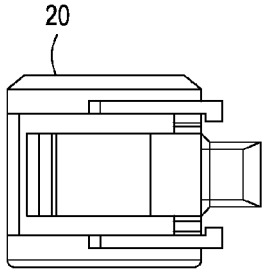
Figure 10E:
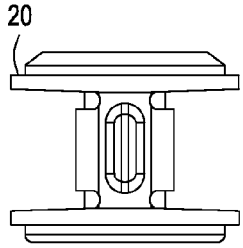
Figure 10F:
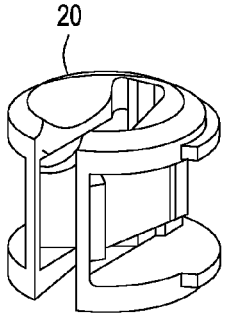

FIG. 9 illustrates another exploded isometric view of an embodiment of one or more substantially cylindrical members 20, a first flange 24, a base 30 with one or more planarly spaced substantially cylindrical openings 34, a slidable member 40, a support 62 that includes slots 64 that are formed to fit rails 66. In addition, slidable member 40 has apertures 39 wherein the first flanges mate. The adjustable tool holder 10 can be assembled and held together by pins or screws 68, which attach the support 62 to the base 30. The substantially cylindrical members 20 and the slidable member 40 in this illustration are fitted into the base before fastening the support 62 and are held by friction. While this embodiment is shown with a base 30 that includes multiple substantially cylindrical members 20, the base 30 may hold a single substantially cylindrical member 20, which can then be inserted or held by hooks, rails, magnetic or other vertical, diagonal or horizontal tool organizers (e.g., a peg board, a tray, a rail) to create customized or customizable tool organizers.

Figure 11A:
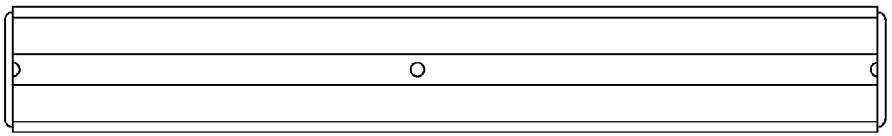
FIG. 11 depicts different views of another embodiment of the adjustable tool holder of the present invention.
Figure 11B:
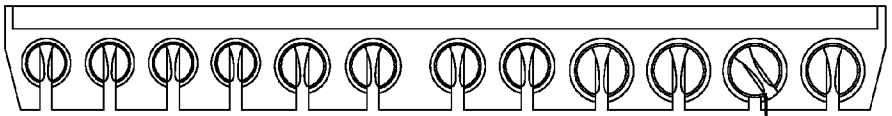
Figure 11C:
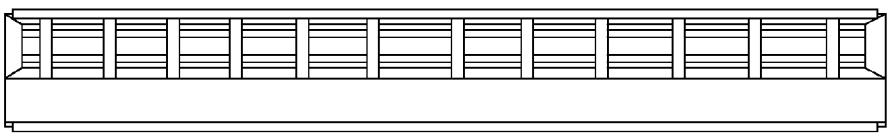
Figure 11D:
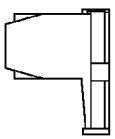
Figure 11E:
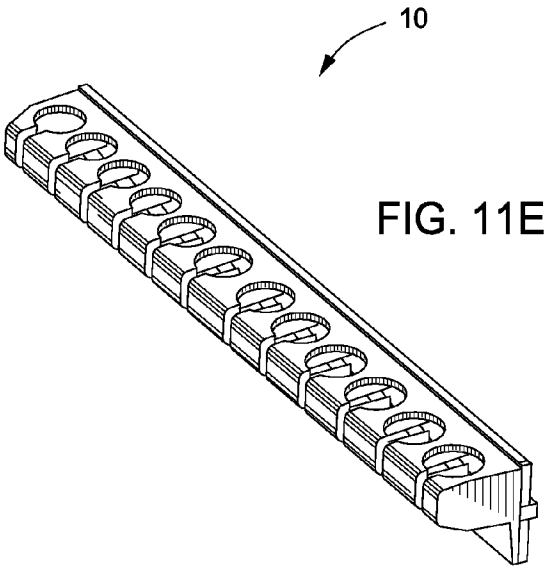

FIGS. 10*a* to 10*f* are a top (10*a*), top cross-sectional (10*b*), side cross-sectional (10*c*), cross-sectional lateral (10*d*), side contralateral view of 10*c* (10*e*), and an isometric view (10*f*) of the substantially cylindrical member 20. In this embodiment, a pincher 70 (10*b*) is formed in the opening 22 (not shown) that also extends outside the cylindrical portion of the substantially cylindrical member 20 to form the first flange 24. As with the other embodiments of the adjustable tool holder 10 of the present invention, a single or more substantially cylindrical members 20 may be placed in base 30 (not shown) that holds a single (or multiple) substantially cylindrical member (s) 20 that may be rotated independently, as shown in FIG. 11*b*.

FIGS. 11*a* to 11*e* shows a bottom (11*a*), top (11*b*), frontal (11*c*), side (11*d*) and isometric (11*e*) views of an assembled adjustable tool holder 10. In FIG. 11(*b*), one of the cylindrical members 20 is depicted as rotated independently. FIG. 11(*c*) also shows the rails 66 within the support 62. In certain embodiments one or more rails may be used and may even be magnetic, to permit organization of tools (not depicted) within the adjustable tool holder 10 against a ferrous material, e.g., the side of a tool cart, for movable use (e.g., attached to the side of a car, plane or truck) and may even include one or more coatings on the rails 66 to prevent scratching or other damage to the surface to which the adjustable tool holder is attached.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

All of the materials and/or methods disclosed and claimed herein can be made and executed without undue experimentation in light of the present disclosure. All such similar substitutes and modifications apparent to those skilled in the art are deemed to be within the spirit, scope and concept of the invention as defined by the appended claims.

What is claimed is:

1. An adjustable tool holder comprising:

a base comprising a front edge and a back edge, one or more planarly spaced substantially cylindrical openings positioned between the front edge and the back edge, and a longitudinal slot extending from the front edge into the one or more planarly spaced substantially cylindrical openings;

one or more substantially cylindrical members secured within the one or more planarly spaced substantially cylindrical openings, wherein each of the one or more substantially cylindrical members comprise a longitudinal channel extending at least partially into each of the one or more substantially cylindrical members, wherein the longitudinal channel and the longitudinal slot are alignable to engage one or more tools positioned through the longitudinal slot and within the longitudinal channel and the one or more substantially cylindrical members are allowed to rotate, and a flange extending from an end plane of each of the one or more substantially cylindrical members and extending through the back edge, wherein the flange can rotate with the one or more substantially cylindrical members;

one or more slidable members positioned about the back edge, wherein the one or more slidable members comprises one or more apertures configured to accept the flange to allow the one or more substantially cylindrical members to rotate as the one or more slidable members are moved to align and unalign the longitudinal channel with the longitudinal slot; and a backplate positioned about the back edge to slidably secure the one or more slidable members between the back edge and the backplate.

2. The adjustable tool holder of claim 1, further comprising one or more first flanges extending from an annulus of each of the one or more substantially cylindrical members and one or more grasps extending from the perimeter of each of the one or more planarly spaced substantially cylindrical openings, wherein the one or more first flanges disposed within each of the one or more grasps constrains rotation of the one or more substantially cylindrical members.

3. The adjustable tool holder of claim 1, further comprising one or more latching members attached to the base and the one or more slidable members, the one or more first flanges extending from the annulus of each of the one or more substantially cylindrical members, the one or more grasps extending from the perimeter of each of the one or more planarly spaced substantially cylindrical openings, and the one or more second flanges extending from an end plane of each of the one or more substantially cylindrical members, wherein the one or more slidable members are attached to each of the one or more second flanges and wherein each of the one or more latching members cause the one or more substantially cylindrical members to rotate in unison.

4. The adjustable tool holder of claim 1, further comprising the one or more latching members attached to the base and each of the one or more slidable members, the one or more first flanges extending from the annulus of each of the one or more substantially cylindrical members, the one or more grasps extending from the perimeter of each of the one or more planarly spaced substantially cylindrical openings, and the one or more second flanges extending from an end plane of each of the one or more substantially cylindrical member members, wherein each of the one or more slidable members is attached to each of the one or more second flanges and wherein each of the one or more latching members cause each of the one or more substantially cylindrical members to rotate in unison.

5. The adjustable tool holder of claim 1, further comprising the one or more latching members attached to the base and each of the one or more slidable members, one or more locking members attached to the base and each of the one or more latching members, the one or more first flanges extending from the annulus of each of the one or more substantially cylindrical members, the one or more grasps extending from the perimeter of each of the one or more planarly spaced substantially cylindrical openings, and the one or more second flanges extending from an end plane of each of the one or more substantially cylindrical members, wherein each of the one or more slidable members is attached to each of the one or more second flanges, wherein each of the one or more latching members cause each of the one or more substantially cylindrical members to rotate in unison, and wherein each of the one or more locking members prevent further movement of each of the one or more latching members.

6. The adjustable tool holder of claim 1, wherein the one or more substantially cylindrical members comprises at least one or more sets of substantially cylindrical members.

7. The adjustable tool holder of claim 1, wherein the one or more substantially cylindrical members comprises at least two of the one or more substantially cylindrical members and each of the at least two of the one or more substantially cylindrical members are of equal diameters.

8. The adjustable tool holder of claim 1, further comprising one or more sets of substantially cylindrical members, wherein each of the one or more sets of substantially cylindrical members are of equal diameters.

9. The adjustable tool holder of claim 1, wherein the one or more substantially cylindrical members comprises at least two of the one or more substantially cylindrical members and each of the at least two of the one or more substantially cylindrical members have equally spaced planar faces.

10. The adjustable tool holder of claim 1, further comprising one or more sets of substantially cylindrical members, wherein each of the one or more sets of substantially cylindrical members has equally spaced planar faces.

11. The adjustable tool holder of claim 1, wherein one or more substantially cylindrical members are metallic, non-metallic, magnetic, non-magnetic, plastic, polymeric, elastomeric, non-elastomeric, malleable or non-malleable.

12. The adjustable tool holder of claim 1, wherein the base is metallic, non-metallic, magnetic, non-magnetic, plastic, polymeric, elastomeric, non-elastomeric, malleable or non-malleable, ferrous, non-ferrous or combinations thereof.

13. The adjustable tool holder of claim 1, further comprising one or more latching members attached to the base and one or more slidable members, one or more first flanges extending from the annulus of each of the one or more substantially cylindrical members, one or more grasps extending from the perimeter of each of the one or more planarly spaced substantially cylindrical openings, one or more second flanges extending from an end plane of each of the one or more substantially cylindrical members, wherein one or more slidable members are attached to each of the one or more second flanges, wherein each of the one or more latching members cause one or more substantially cylindrical members to rotate in unison, and wherein each latching member is metallic, non-metallic, magnetic, non-magnetic, plastic, polymeric, elastomeric, non-elastomeric, malleable, non-malleable or combinations thereof.

* * * * *